US008752920B2

(12) United States Patent
Rapp

(10) Patent No.: US 8,752,920 B2
(45) Date of Patent: Jun. 17, 2014

(54) REFRIGERATOR AND/OR FREEZER

(75) Inventor: Stefan Rapp, Edelbeuren (DE)

(73) Assignee: Liebherr-Hausgerate Oschsenhausen GmbH, Ochsenhausen (DE)

( * ) Notice: Subject to any disclaimer, the term of this patent is extended or adjusted under 35 U.S.C. 154(b) by 913 days.

(21) Appl. No.: 12/227,586

(22) PCT Filed: May 23, 2007

(86) PCT No.: PCT/EP2007/004618

§ 371 (c)(1),
(2), (4) Date: May 13, 2009

(87) PCT Pub. No.: WO2007/134863

PCT Pub. Date: Nov. 29, 2007

(65) Prior Publication Data

US 2009/0260390 A1 Oct. 22, 2009

(30) Foreign Application Priority Data

May 23, 2006 (DE) ..... 20 2006 008 238 U

(51) Int. Cl.
*A47B 96/00* (2006.01)

(52) U.S. Cl.
USPC ..... 312/406; 312/405

(58) Field of Classification Search
USPC ..... 312/405, 405.1, 326–329, 401, 406, 312/406.2; 62/440, 465
See application file for complete search history.

(56) References Cited

U.S. PATENT DOCUMENTS

| | | | | | |
|---|---|---|---|---|---|
| 139,168 | A * | 5/1873 | Lewis | 160/96 |
| 288,427 | A * | 11/1883 | Gray | 312/405 |
| 1,209,544 | A * | 12/1916 | Bolger | 312/405 |
| 2,078,552 | A * | 4/1937 | Young | 312/405 |
| 2,810,266 | A * | 10/1957 | Wurtz et al. | 62/441 |
| 3,290,109 | A * | 12/1966 | Vanegas | 312/326 |
| 4,706,363 | A * | 11/1987 | Taylor, Jr. | 29/453 |
| 2004/0108798 | A1 * | 6/2004 | Laible | 312/405 |

FOREIGN PATENT DOCUMENTS

| | | |
|---|---|---|
| DE | 3002512 | 8/1980 |
| FR | 1362178 | 5/1964 |
| FR | 2365087 | 4/1978 |
| WO | 2007/062924 | 7/2007 |

* cited by examiner

*Primary Examiner* — James O Hansen
(74) *Attorney, Agent, or Firm* — Dilworth & Barrese, LLP

(57) ABSTRACT

A refrigerator and/or freezer with a carcass is provided, in which at least one inner container is arranged for receiving goods to be refrigerated and/or frozen, and at least one bearing block for mounting one or more doors by which the carcass can be closed. An interconnecting element is provided, which extends in a region between two walls of the carcass, and the bearing block is fixed to the interconnecting element or to a component directly or indirectly connected with the interconnecting element.

21 Claims, 12 Drawing Sheets

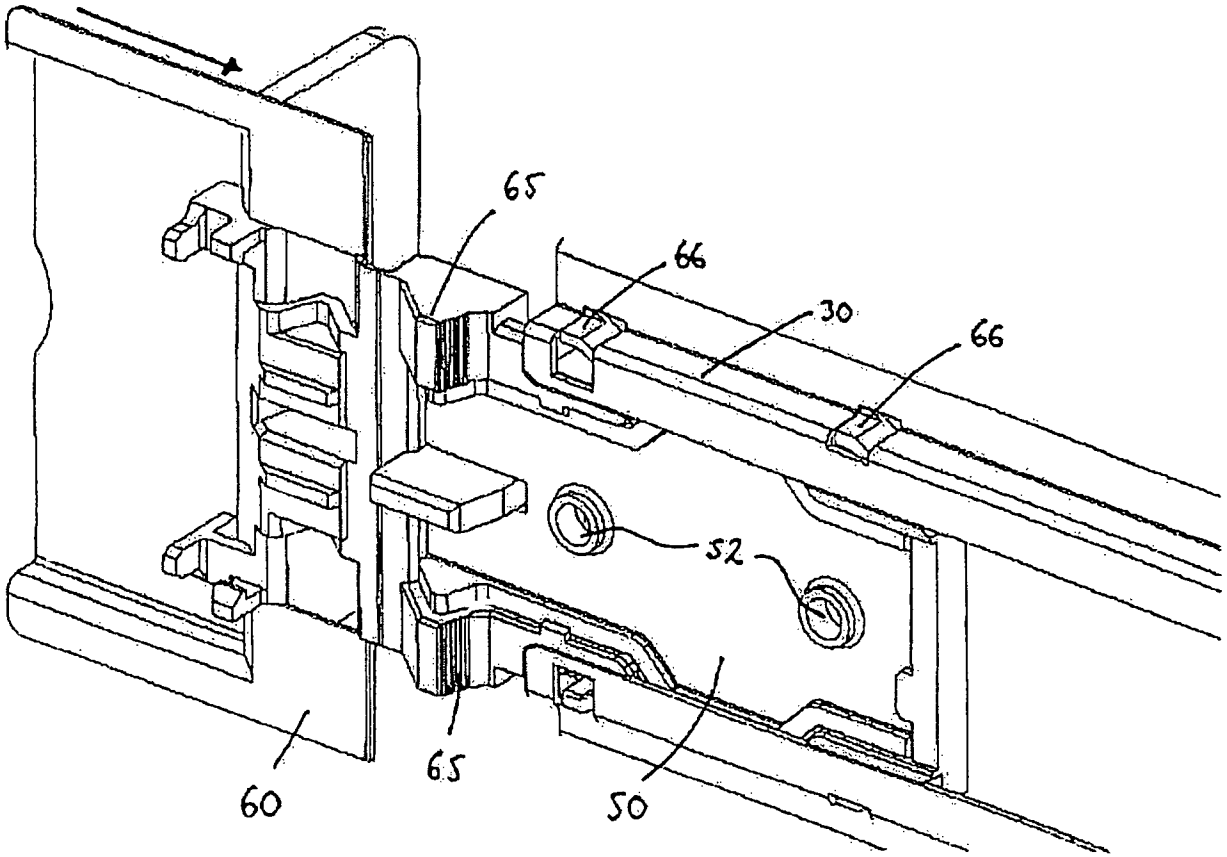
Figure 2.1

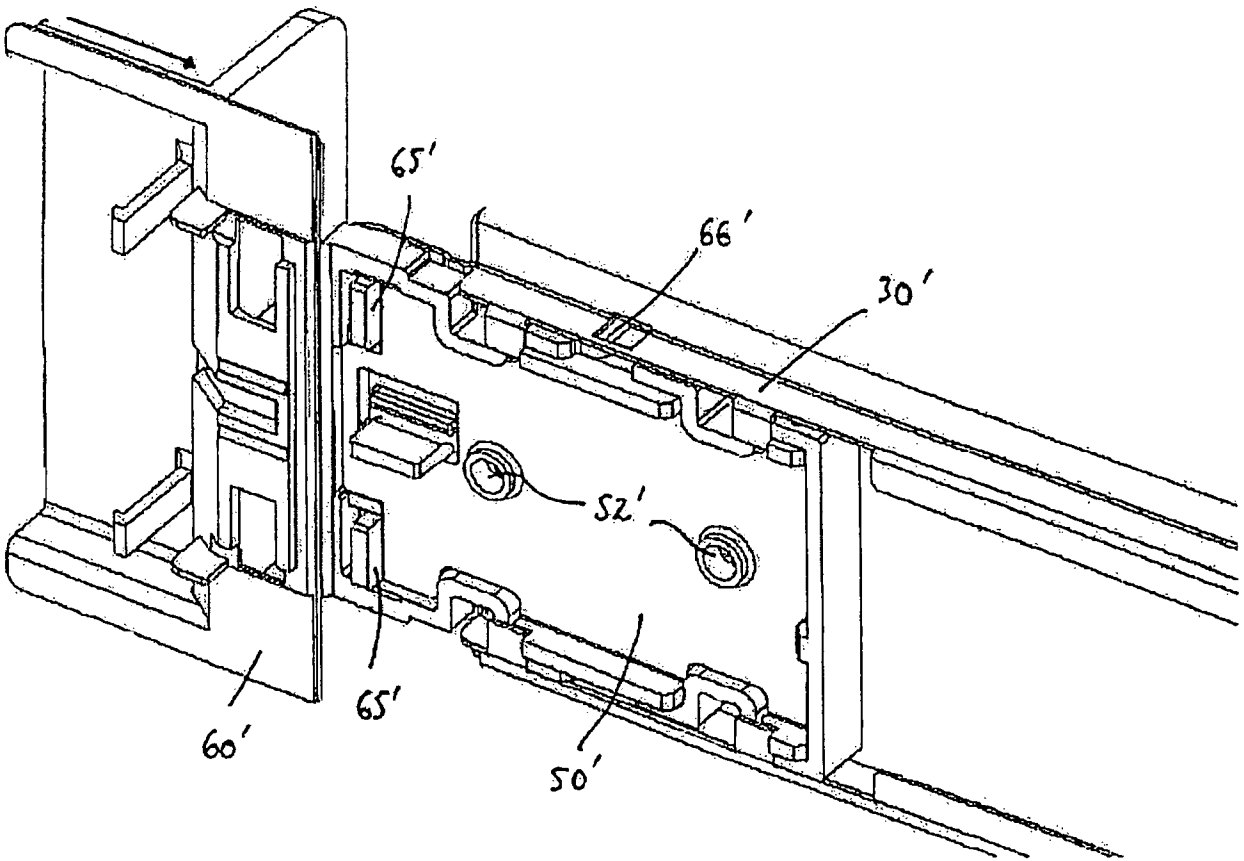
Figure 2.2

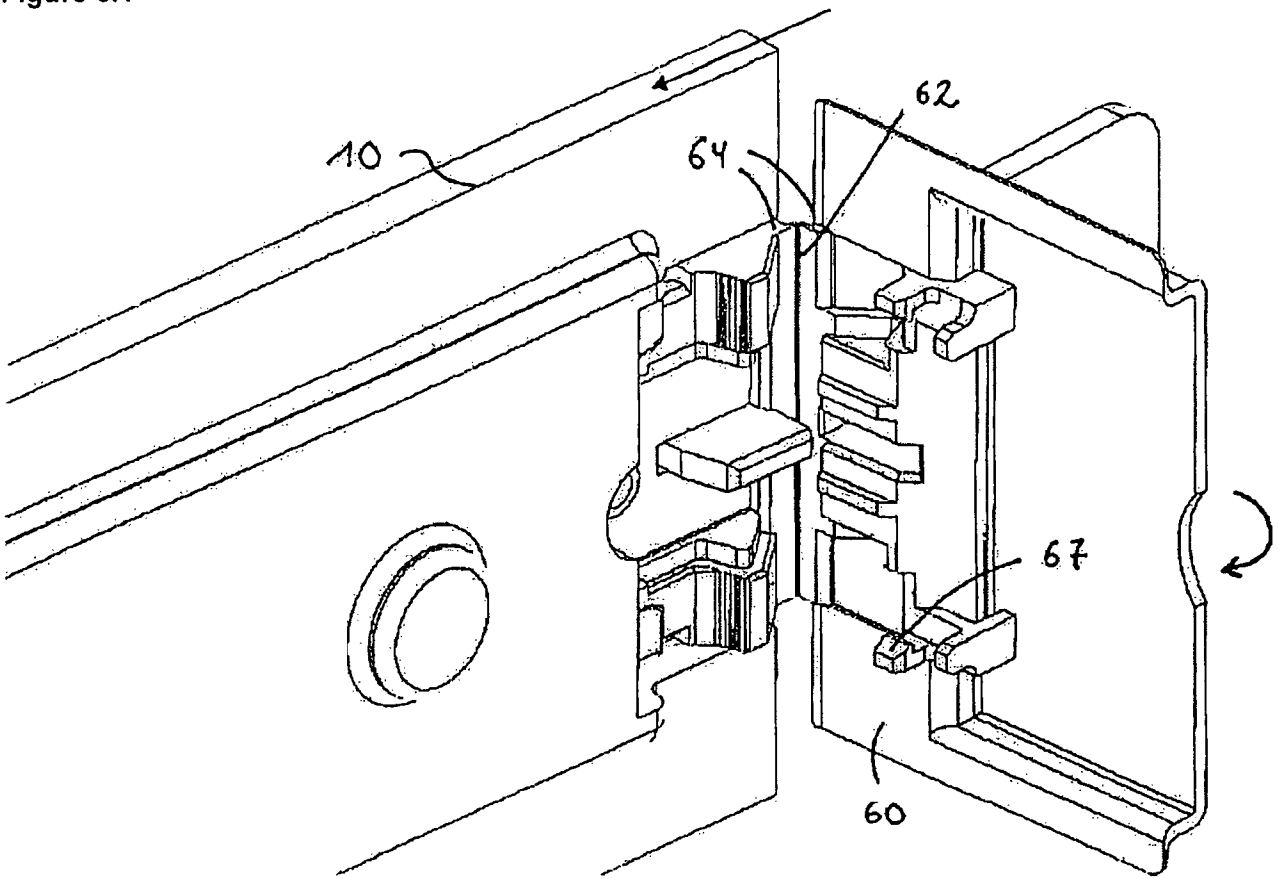
Figure 3.1

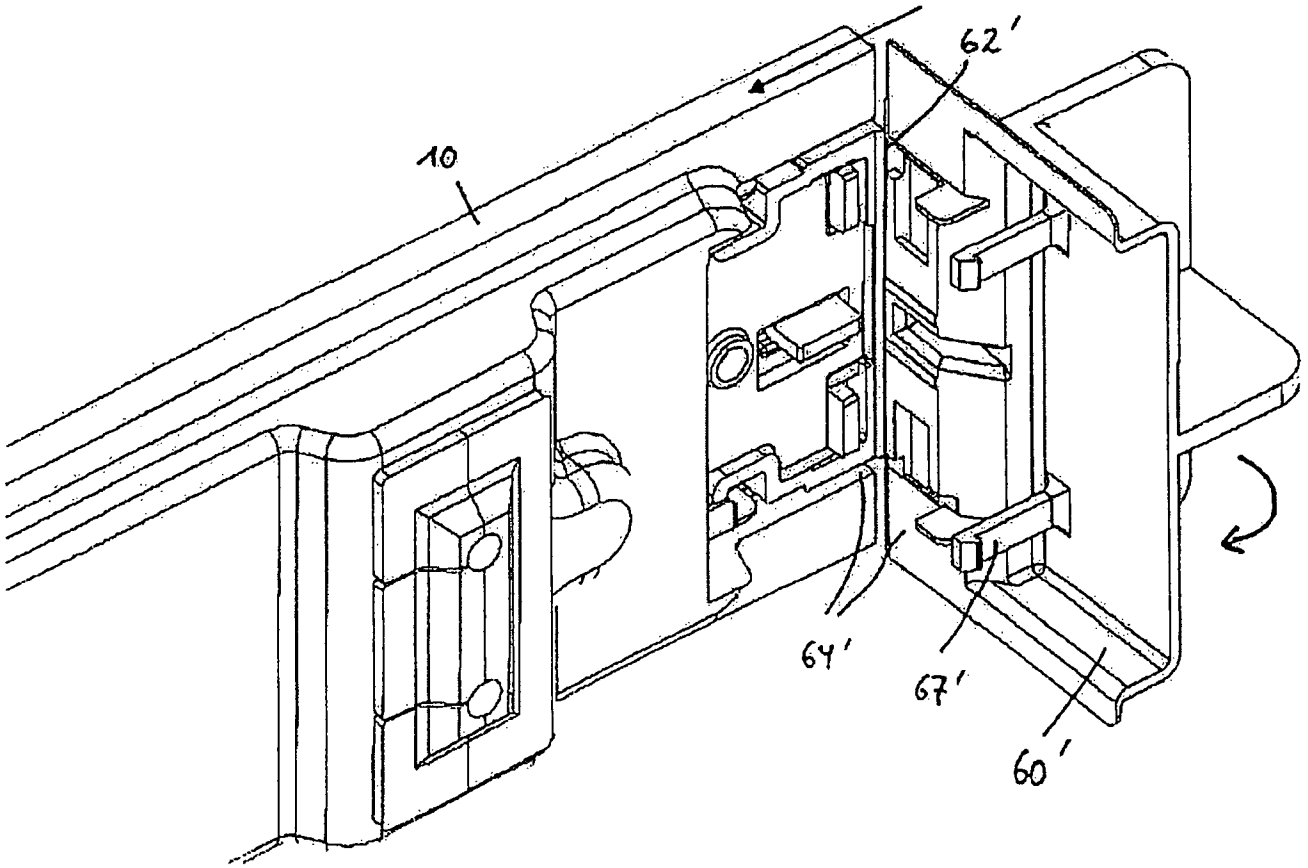
Figure 3.2

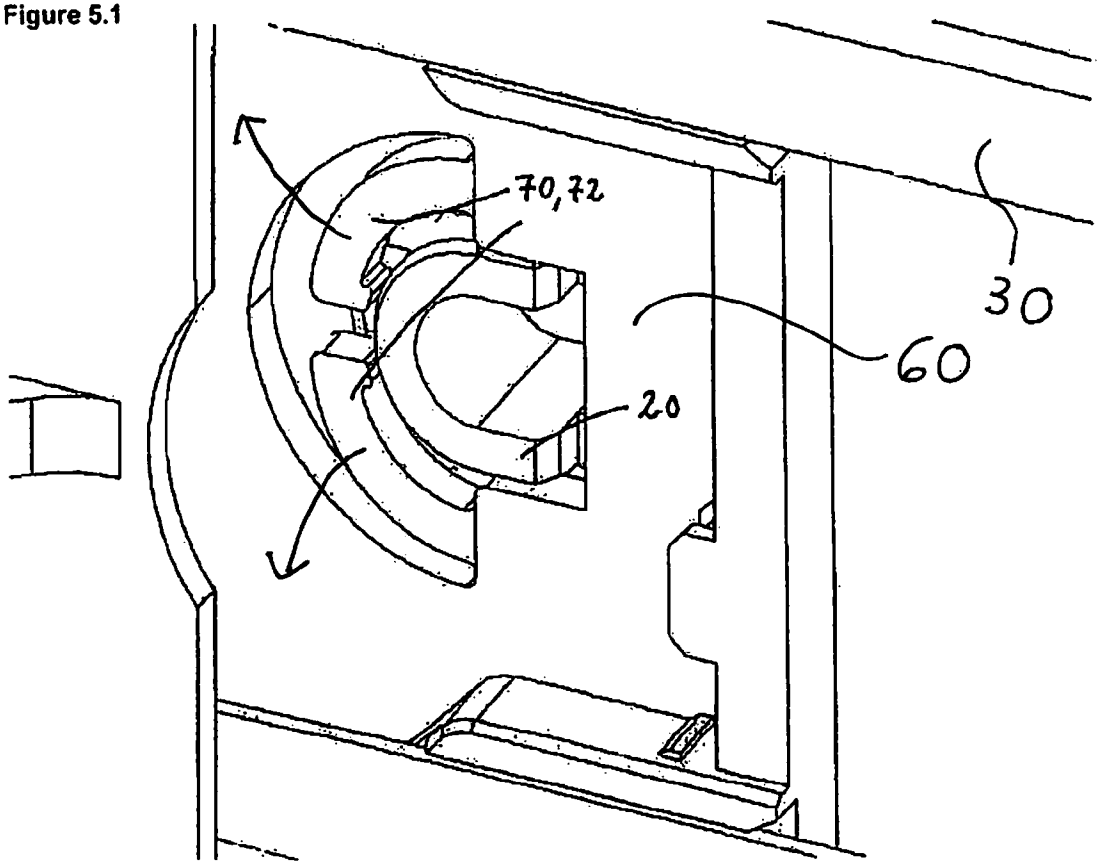
Figure 5.1

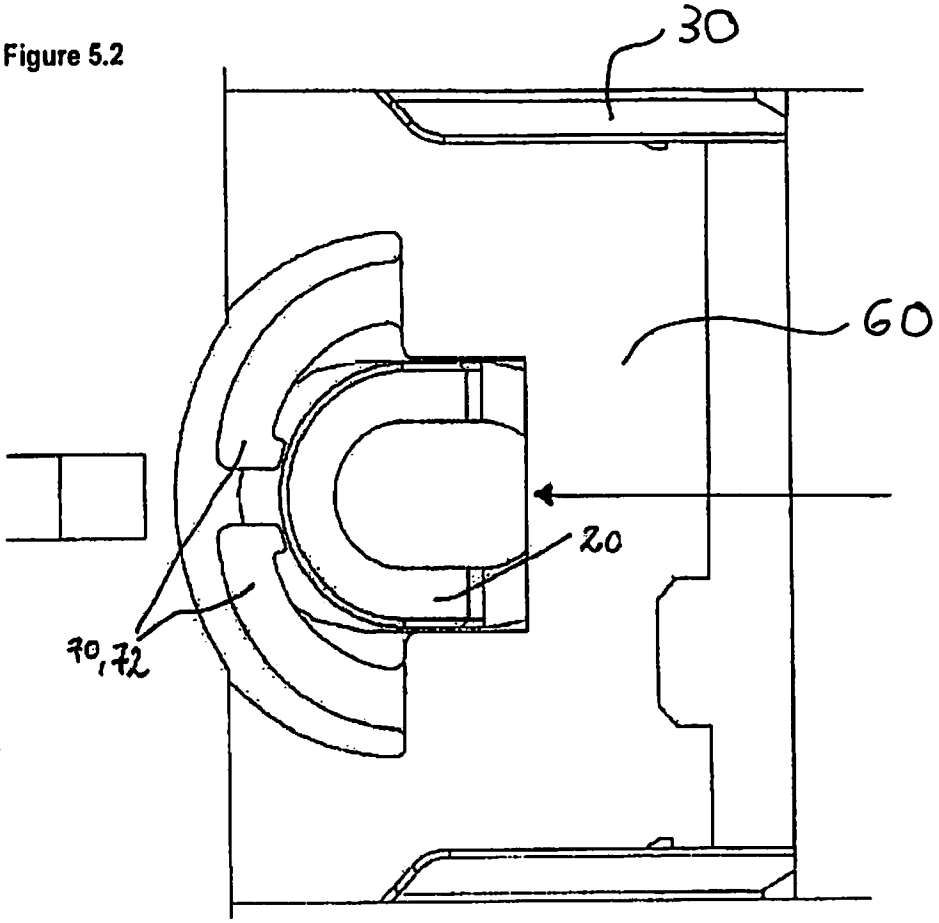
Figure 5.2

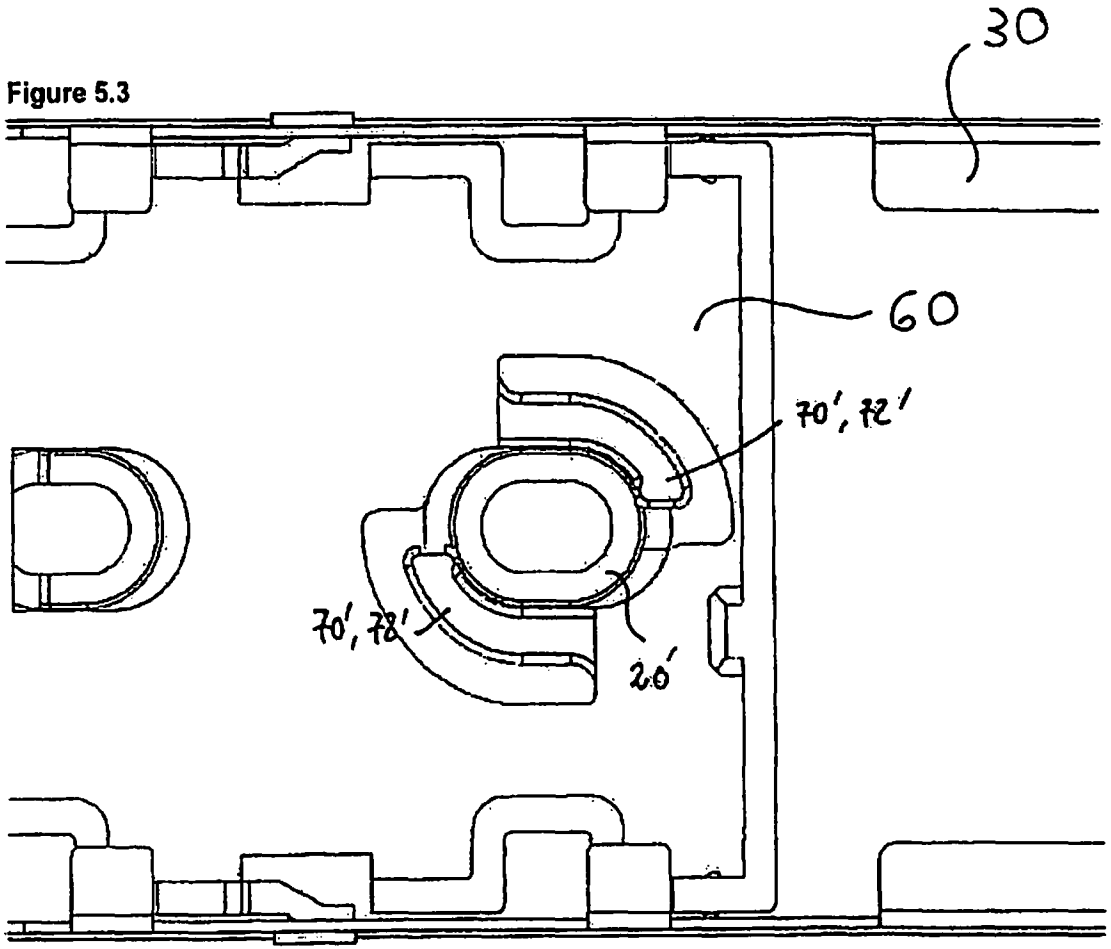
Figure 5.3

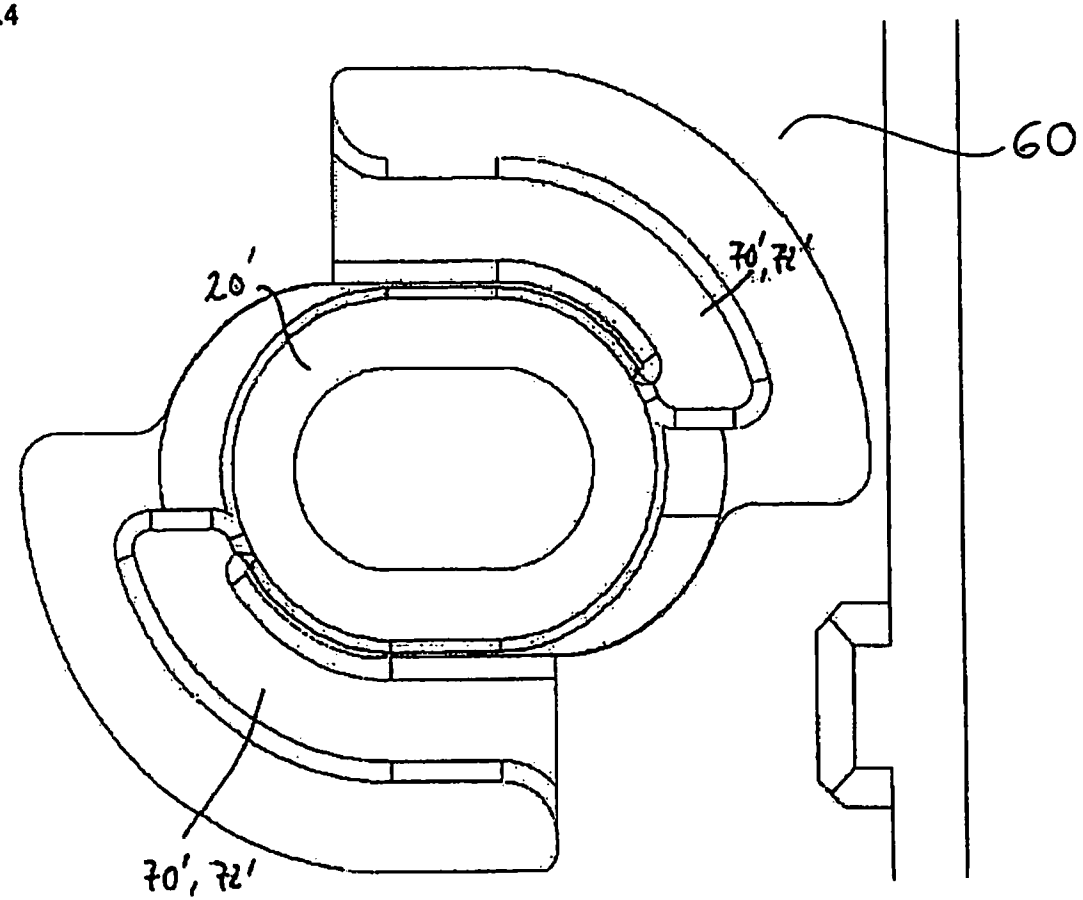
Figure 5.4

REFRIGERATOR AND/OR FREEZER

BACKGROUND OF THE INVENTION

This invention relates to a refrigerator and/or freezer with a carcass, in which at least one inner container is arranged for receiving goods to be refrigerated and/or frozen, and with at least one bearing block for mounting one or more doors by means of which the carcass can be closed.

From the prior art, refrigerators and freezers are known, in which the inner container is locked by means of fastening screws which are also used for fixing the bearing block to the appliance. The fastening screws thus are used not only for mounting the bearing block to the appliance carcass, but also for fixing the inner container. The inner container thus is not arranged in a floating manner, which possibly involves the disadvantage that impressions of the foaming core are visible in the inner container.

FIG. 1 shows such arrangement known from the prior art, in which the bearing block is designated with reference numeral 20, the fastening screws with reference numeral 100, a portion of the side wall with reference numeral 40, and the inner container with reference numeral 10.

As in appliances known from the prior art, the screw connection of the bearing block is realized by means of oblong holes, this can furthermore involve the disadvantage that the mounting position of the bearing block differs from appliance to appliance, which can lead to correspondingly different positions of the door or doors. A further disadvantage in appliances known from the prior art consists in that adjusting the bearing block with mounted doors is difficult. Furthermore, embodiments are known from the prior art, in which the bearing block includes holes for receiving the fastening screw, which are, however, not configured as oblong holes. This case involves the further disadvantage that there is no possibility for adjusting the bearing block and hence for adjusting the doors.

SUMMARY OF THE INVENTION

It is the object underlying the present invention to develop a refrigerator and/or freezer as mentioned above such that the possibility is opened up to realize a high accuracy when mounting the bearing block and the doors and/or to avoid said impressions of the foaming core in the inner container.

This object is solved by a refrigerator and/or freezer with the features herein. Accordingly, it is provided that in a region between at least two walls of the carcass of the appliance at least one interconnecting element extends, and that the bearing block is fixed to the interconnecting element or to a component directly or indirectly connected with the interconnecting element. In accordance with the invention, it thus is provided that the bearing block is mounted to the interconnecting element or to a component connected therewith, which opens up the possibility of a floating arrangement of the container, i.e. the same is not fixed by the fastening screw(s) of the bearing block, although such configuration likewise is comprised by the invention.

In a preferred aspect of the invention, it thus is provided that the inner container is accommodated in a floating manner and is not fixed by the fastening elements, by means of which the bearing block is attached to the carcass.

This invention furthermore relates to a refrigerator and/or freezer with a carcass, in which at least one inner container is arranged for receiving goods to be refrigerated and/or frozen, wherein an interconnecting element is provided, which extends in a region between at least two walls, for instance side walls, of the carcass, and wherein at least one connecting element is provided, which connects the interconnecting element with the wall or walls and is attached to the inner container. Such configuration also provides for the floating arrangement of the inner container, which in this embodiment of the invention is disposed at the connecting element and is mounted to the same for instance by a latch or clamp connection.

In a further aspect of the invention it is provided that said interconnecting element is directly or indirectly connected with the walls, e.g. with the side walls of the carcass of the appliance. It is conceivable to realize a firm connection between wall and interconnection for instance by means of a suitable connecting element, which in addition provides for realizing a high accuracy when mounting the bearing block or when mounting the doors, and allows the floating accommodation of the inner container.

In a further aspect of the invention it is provided that at least one connecting element connects the interconnecting element and/or the inner container with one or more walls, e.g. both side walls of the carcass of the appliance.

Furthermore, a connecting element can be provided, by means of which the interconnecting element is connected with the inner container. Said two connecting elements can be one and the same component.

The walls mentioned above can for instance be side walls, partitions of refrigerators or freezers, such as e.g. chest freezers.

The connecting element can include a component, for instance a plate, or be connected with the same, which includes e.g. threaded holes or other fastening means for mounting the bearing block.

In a further aspect of the invention it is provided that the interconnecting element is locked to the connecting element(s) by means of a latch or clamp connection. Furthermore, it can be provided that one or more walls, e.g. both side walls of the carcass of the appliance, are connected with the connecting element via a latch or clamp connection.

Furthermore, it can be provided that the inner container also is connected with the connecting element via a latch or clamp connection. In a preferred aspect of the invention, the connecting element is latched with the interconnecting element, is furthermore used for locking the inner container, and finally is also latched with the wall or walls, e.g. side walls, of the carcass of the appliance. The connecting element furthermore can include a mounting plate or some other component, which includes threaded holes in which fastening screws for the bearing block are received.

In a further aspect of the invention, the connecting element for instance can include two elements connected with each other by means of a hinge, preferably by means of a film hinge, and pivotally mounted relative to each other, between which a portion of the inner container is accommodated in the condition of the elements swivelled against each other.

In a particularly preferred aspect of the invention, it is provided that the appliance includes means for fixing the bearing block in a preferred position. In this way, it is possible to choose a uniform mounting position of the bearing block and hence also ensure corresponding positions of the doors.

Said means can be formed for instance by a spring or by a screw, by means of which the bearing block can be fixed in a "zero position", but which furthermore provide for an adjustability of the bearing block.

Said means can be formed by one or more resilient tabs, which are arranged on the connecting element or on another component. Furthermore, said means can be formed by a screw which fixes the bearing block relative to the interconnecting element. It can also be provided that said means are formed by a screw which is located in a threaded hole of the bearing block and which is arranged such that it acts on a fastening screw by means of which the bearing block is fixed to the appliance.

BRIEF DESCRIPTION OF THE DRAWINGS

Further details and advantages of the invention will be explained in detail with reference to an embodiment illustrated in the drawing, in which.

DESCRIPTION OF THE PREFERRED EMBODIMENTS

Figure 1:
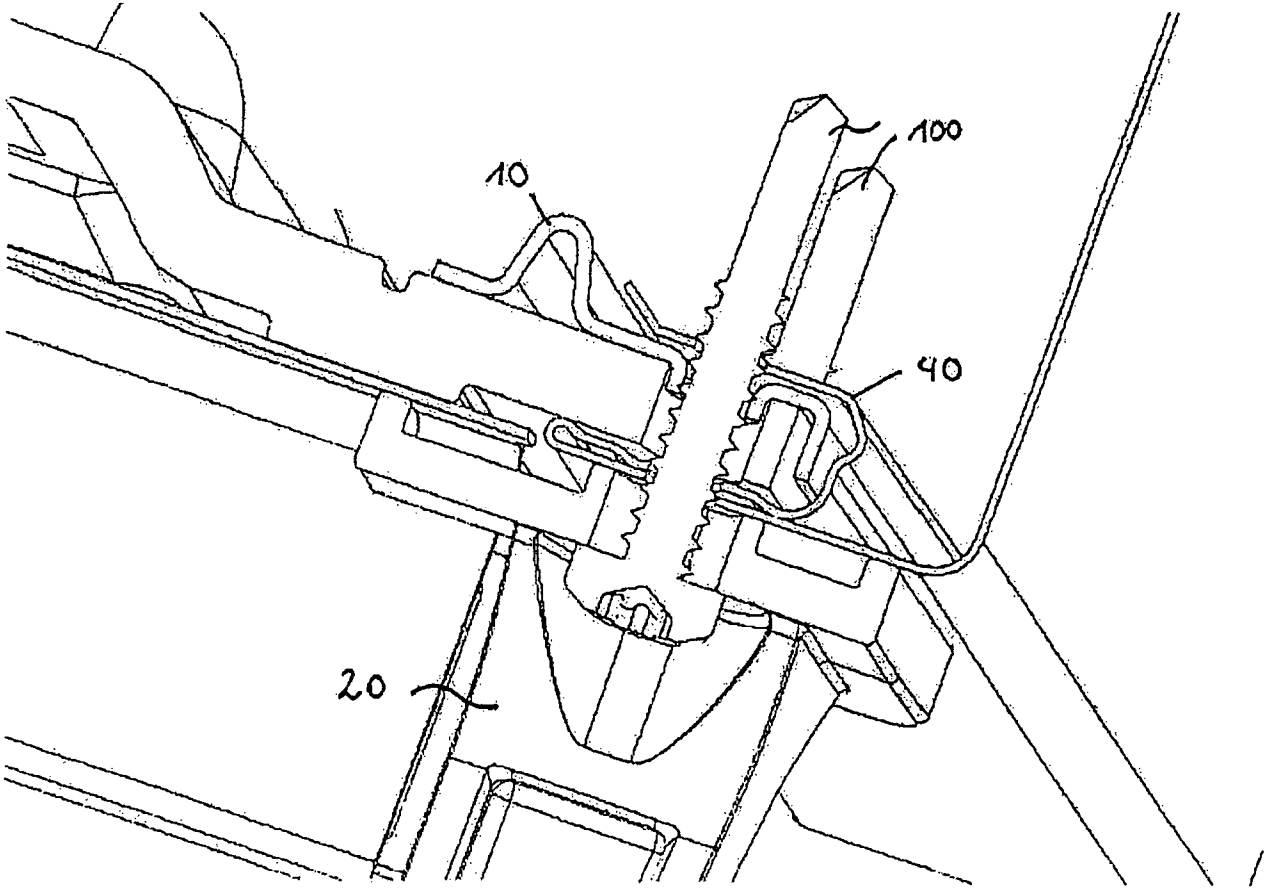
Figure 1 (Prior Art)
FIG. 1: shows a perspective sectional representation through a refrigerator and/or freezer at the level of the bearing block in accordance with the prior art, FIGS. 2.1, 2.2: show perspective representations of a connecting element with mounting plate and interconnecting element, FIGS. 3.1, 3.2: show perspective representations of the connecting element as shown in FIGS. 2.1, 2.2 with inner container.

FIG. 2.1 shows the component 60 subsequently referred to as corner connecting element, which connects the interconnecting element 30 with the inner container and with a side wall of the appliance. The interconnecting element 30 extends for instance at the level between two compartments of the appliance located one above the other across the entire width or an essential part of the width of the appliance, and in its two terminal regions is each connected with one of the corner connecting elements 60. The interconnecting element 30 extends between the side walls of the appliance, for instance between a freezing compartment and a cooling compartment of the appliance.

At its two ends, the interconnecting element 30 includes openings in which the latching hooks 66 of the corner connecting element 60 engage, as is shown in FIG. 2.1. For mounting the corner connecting element 60 to the interconnecting element 30, the corner connecting element 60 is laterally inserted into grooves of the interconnecting element 30 in direction of arrow, until the latching hooks 66 of the corner connecting element 60 engage in corresponding recesses of the interconnecting element 30, as is shown in FIG. 2.1.

The corner connecting element 60 furthermore includes latching hooks 65 for the side wall of the appliance yet to be mounted. The corner connecting element 60 furthermore includes a mounting plate 50 made of metal, which is connected with the same for instance by a latch connection and includes two threaded holes 52 arranged one beside the other, as can also be taken from FIG. 2.1.

The arrow of FIG. 2.1 shows the direction of insertion of the corner connecting element 60 into the grooves arranged on the upper and lower surfaces of the interconnecting element 30.

FIG. 2.2 shows the arrangement of FIG. 2.1 in a different configuration. Identical parts or parts having the same function are designated with the same, but primed reference numerals as in FIG. 2.1.

When the corner connecting element 60 with the mounting plate 50 is latched with the interconnecting element 30, the interconnecting element 30 is mounted on the inner container 10. As can be taken from FIG. 3.1, the corner connecting element 60 consists of the film hinge 62 and two elements 64 which can be swivelled relative to each other about the hinge 62. Upon mounting the interconnecting element 30 with the corner connecting element 60 on the inner container 10, the element 64 of the corner connecting element 60, which is not connected with the inner container 10, is swivelled about 180°, as is illustrated by the arrow in FIG. 3.1, until it rests against the other side of the inner container 10, so that the two elements 64 of the corner connecting element 60 are located substantially parallel to each other. The folded position is secured by latching hooks 67, which engage either in the inner container 10 or in the other one of the elements 64 of the corner connecting element 60. In this way, the inner container 10 is fixed between the elements 64 of the corner connecting element.

In a further step, the side wall 40 is latched with the latching hooks 65 of the corner connecting element 60 without any clearance.

The corner connecting element 60 thus serves to connect the interconnecting element 30, the side wall 40 and the inner container 10.

FIG. 3.2 shows the arrangement of FIG. 3.1 with the corner connecting element illustrated in FIG. 2.2. Identical parts or parts having the same function are designated with the same, but primed reference numerals as in FIG. 3.1.

Figure 4:
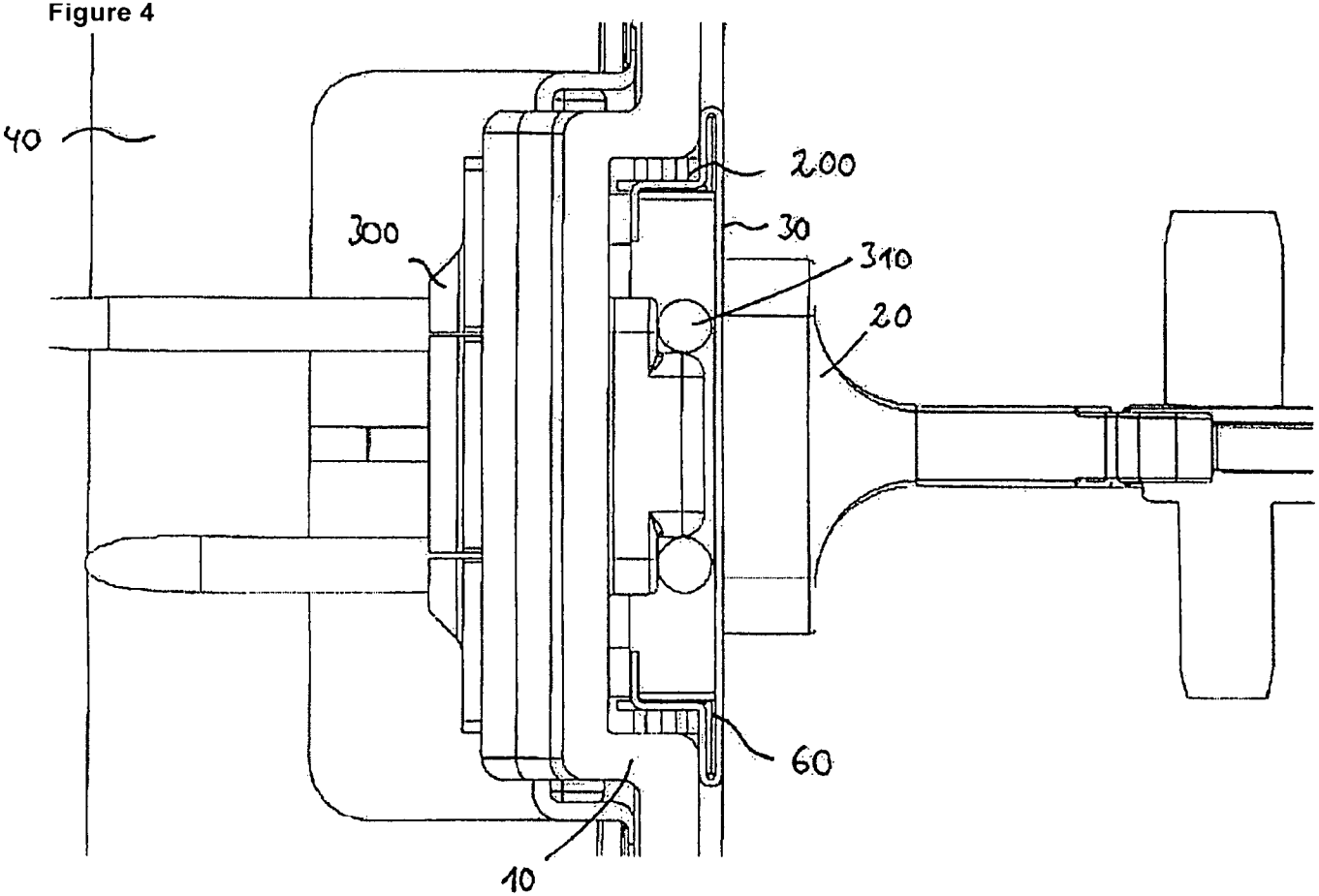
FIG. 4: shows a sectional representation through a refrigerator and/or freezer at the level of the bearing block in accordance with the present invention, FIGS. 5.1-5.4: show different views of the connecting element with integrated zero position.

FIG. 4 shows the arrangement with mounted bearing block 20 in a sectional representation. Reference numeral 40 designates a side wall, which by means of said latching hooks 65 is connected with the corner connecting element 60 without any clearance. The inner container 10 is accommodated between two elements 64 of the corner connecting element 60 and in the embodiment shown in FIG. 4 has a clearance to the inner container 10, which is designated by reference numeral 200. On its front side, the interconnecting element 30 latched with the corner connecting element 60 includes holes through which the fastening screws are inserted, which fix the bearing block 20 to the appliance. Said fastening screws then extend through the threaded holes 52 of the plate 50 as shown in FIG. 2, which plate is connected with the corner connecting element 60.

In FIG. 4, reference numeral 300 designates a grommet, which serves to guide the frame heater 310 through the inner container.

In a rear view, FIG. 5.1 shows a segment of the corner connecting element 60 without mounting plate. From this view, it can be taken that the corner connecting element 60 includes a recess in which the spring 70 is disposed, which is formed by the two tabs 72. These two tabs 72 can be bent radially to the outside, as is indicated by arrows in FIG. 5.1.

FIG. 5.2 illustrates the situation in which the bearing block 20 is fixed in the zero position by a positive connection. The bearing block 20, of which a protrusion shown in the recess of the corner connecting element 60 can be seen in FIGS. 5.1, 5.2, is held in the zero position by the tabs 72 of the spring 70. FIGS. 5.1, 5.2 show the hole of the bearing block configured as an oblong hole, through which a fastening screw extends in the mounted condition, whose male thread meshes with the female thread of the threaded hole 52 of the plate 50, which is not shown in FIGS. 5.1, 5.2 and which adjoins the corner connecting element 60 on the side facing the viewer.

If the bearing block is to be adjusted, this is easily possible by applying a force as shown in FIG. 5.2, whereby the bearing block 20 moves against the spring force of the tabs 72.

FIGS. 5.3 and 5.4 show an arrangement with diametrically opposite springs 70' with spring tabs 72, between which the bearing block 20' is accommodated.

Figure 6:
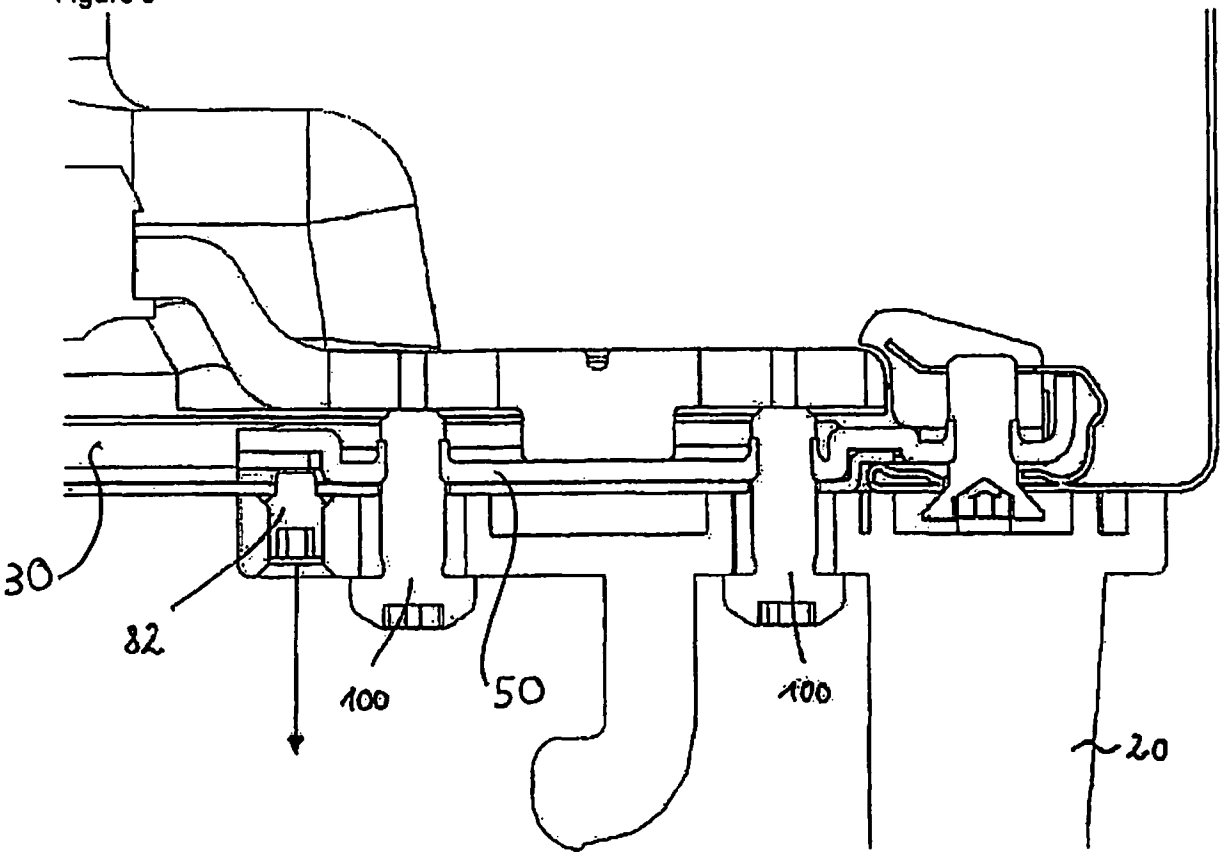
FIG. 6: shows a sectional representation through the refrigerator and/or freezer of the invention at the level of the bearing block with an adjusting screw in a first embodiment.

FIG. 6 shows an alternative possibility for realizing a preferred position, i.e. a zero position of the bearing block 20. In the embodiment illustrated in FIG. 6, which shows the arrangement in a sectional view, an adjusting screw 82 is provided, which is guided through a corresponding hole in the interconnecting element 30, as is shown in FIG. 6. The fastening screws 100 serve to mount the bearing block 20 on the mounting plate 50, which includes said threaded holes 52.

As can furthermore be taken from FIG. 6, the bearing block 20 includes a threaded hole for receiving the adjusting screw 82, via which the adjusting screw 82 can be screwed out of the fixing hole in the interconnecting element 30 or can be screwed into the same. If the bearing block 20 is to be adjusted, said adjusting screw 82 must be screwed out of the bearing block.

Figure 7:
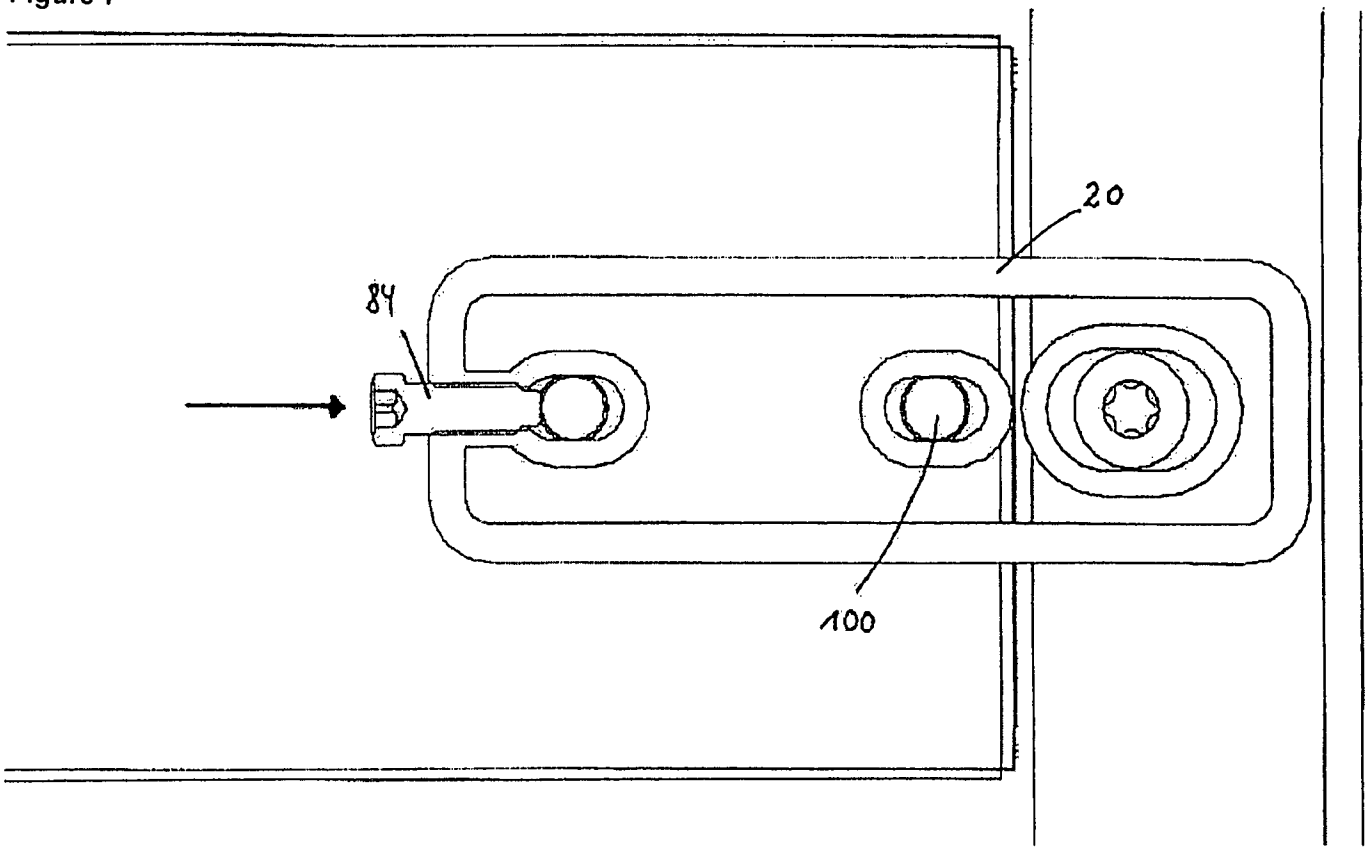
FIG. 7: shows a sectional representation through the refrigerator and/or freezer of the invention at the level of the bearing block with an adjusting screw in a second embodiment.

FIG. 7 shows another possibility for realizing a bearing block with zero position, in which the adjusting screw 84 is provided on the end face. In this case, the adjusting screw thus does not extend parallel to the fastening screws, as is the case in FIG. 6, but vertical thereto. FIG. 7 shows the arrangement in a sectional representation, wherein reference numeral 100 designates the fastening screws and reference numeral 84 designates the adjusting screw. Vertical to the oblong holes for receiving the fastening screws 100, a threaded hole extends in a lateral region of the bearing block such that this threaded hole communicates with one of the oblong holes for receiving the fastening screw 100. The adjusting screw 84 is screwed into this threaded hole, until its terminal region rests against the shaft of the fastening screw 100, as is shown in FIG. 7. For mounting purposes, the bearing block 20 with the adjusting screw 84 is attached, for instance urged to the outside, and the fastening screws are screwed in. For adjusting the bearing block 20 it is necessary to readjust the adjusting screw 84. The mounted door urges the adjusting screw 84 against the fastening screw 100, which involves the advantage that the bearing block 20 cannot be displaced anymore.

The present invention allows to provide a firm connection between the side walls or between the side wall and the interconnection, by means of which a high accuracy can be realized when mounting the bearing block or when mounting the doors. Another advantage consists in that it is possible in accordance with the invention to accommodate the inner container in a floating manner. In preferred aspects of the invention, the bearing block can be mounted via oblong holes with integrated zero position, which involves the advantage that a future alignment of the doors by means of the bearing block with oblong holes is possible at any time, without parts having to be replaced at the bearing block.

The invention claimed is:

1. A refrigerator and/or freezer having a carcass, at least one inner container (10) arranged within the carcass for receiving goods to be refrigerated and/or frozen, at least one bearing block (20) arranged for mounting thereon, one or more doors by which the carcass can be closed, at least one interconnecting element (30) arranged to extend in a region between two walls (40) of the carcass and be mounted thereon, be fixedly connected to the bearing block (20) and clamp the inner container (10) between opposing surfaces (64) of a connecting element (60), such that the container (10) is mounted on the carcass without being fixed to the bearing block (20), wherein the interconnecting element (30) is locked to the connecting element (60) by at least one latching hook (66) associated with the connecting element (60) which engages a corresponding aperture in the interconnecting element (30).

2. The refrigerator and/or freezer according to claim 1, wherein the interconnecting element (30) is directly or indirectly connected with the walls (40) of the carcass of the appliance.

3. The refrigerator and/or freezer according to claim 2, additionally comprising a component directly or indirectly connected with the interconnecting element (30) and in the form of a plate (50) and including one or more threaded holes (52).

4. The refrigerator and/or freezer according to claim 3, wherein means are provided by which the bearing block (20) can be fixed in a preferred position.

5. The refrigerator and/or freezer according to claim 1, additionally comprising a component directly or indirectly connected with the interconnecting element (30) and in the form of a plate (50) and including one or more threaded holes (52).

6. The refrigerator and/or freezer according to claim 5, wherein the component/plate (50) is part of the connecting element (60) or is connected with the connecting element (60).

7. The refrigerator and/or freezer according to claim 1, wherein the connecting element (60) connects the interconnecting element (30) and/or the inner container (10) with one or more walls (40) of the carcass of the appliance.

8. The refrigerator and/or freezer according to claim 1, wherein at least one connecting element (60) is provided, which connects the interconnecting element (30) with the inner container (10).

9. The refrigerator and/or freezer according to claim 8, wherein said connecting element (60) connects the interconnecting element (30) and/or the inner container (10) with one or more walls (40) of the carcass of the appliance.

10. The refrigerator and/or freezer according to claim 1, wherein means are provided by which the bearing block (20) can be fixed in a preferred position.

11. The refrigerator and/or freezer according to claim 10, wherein said means are formed by a spring (70) or screw (82).

12. The refrigerator and/or freezer according to claim 10, wherein said means are formed by a screw (84), which is located in a threaded hole of the bearing block (20) and arranged such that it acts on a fastening screw (100) by which the bearing block (20) is fixed to the appliance.

13. The refrigerator and/or freezer according to claim 1, wherein the latching hook (66) resiliently engages the corresponding aperture in the interconnecting element (30).

14. A refrigerator and/or freezer with a carcass, in which at least one inner container (10) is arranged for receiving goods to be refrigerated and/or frozen, wherein an interconnecting element (30) is provided, which extends in a region between two walls (40) of the carcass, and at least one connecting element (60) is provided, which connects the interconnecting element (30) with the wall or walls (40), and to which the inner container (10) is clamped between opposing surfaces (64) of the connecting element (60) itself, wherein the interconnecting element (30) is locked to the connecting element (60) by at least one latching hook (66) associated with the connecting element (60) which engages a corresponding aperture in the interconnecting element (30).

15. The refrigerator and/or freezer according to claim 14, additionally comprising a component directly or indirectly connected with the interconnecting element (30) and in the form of a plate (50) and including one or more threaded holes (52).

16. The refrigerator and/or freezer according to claim 14, wherein means are provided by which the bearing block (20) can be fixed in a preferred position.

17. The refrigerator and/or freezer according to claim 14, wherein the latching hook (66) resiliently engages the corresponding aperture in the interconnecting element (30).

18. A refrigerator and/or freezer having a carcass, at least one inner container (10) arranged within the carcass for receiving goods to be refrigerated and/or frozen, at least one bearing block (20) arranged for mounting thereon, one or more doors by which the carcass can be closed, at least one interconnecting element (30) arranged to extend in a region between two walls (40) of the carcass and be mounted thereon, be fixedly connected to the bearing block (20) and clamp the inner container (10) between opposing surfaces (64) of a connecting element (60), such that the container (10) is mounted on the carcass without being fixed to the bearing block (20), wherein the connecting element (60) connects the interconnecting element (30) and/or the inner container (10) with one or more walls (40) of the carcass of the appliance, and wherein the interconnecting element (30) is locked to the connecting element (60) by a latch or clamp connection.

19. A refrigerator and/or freezer having a carcass, at least one inner container (10) arranged within the carcass for receiving goods to be refrigerated and/or frozen, at least one bearing block (20) arranged for mounting thereon, one or more doors by which the carcass can be closed, at least one interconnecting element (30) arranged to extend in a region between two walls (40) of the carcass and be mounted thereon, be fixedly connected to the bearing block (20) and clamp the inner container (10) between opposing surfaces (64) of the connecting element (60) itself, such that the container (10) is mounted on the carcass without being fixed to the bearing block (20), wherein the connecting element (60) connects the interconnecting element (30) and/or the inner container (10) with one or more walls (40) of the carcass of the appliance, and wherein one or more walls (40) of the carcass of the appliance are connected with the connecting element (60) via a latch or clamp connection.

20. A refrigerator and/or freezer having a carcass, at least one inner container (10) arranged within the carcass for receiving goods to be refrigerated and/or frozen, at least one bearing block (20) arranged for mounting thereon, one or more doors by which the carcass can be closed, at least one interconnecting element (30) arranged to extend in a region between two walls (40) of the carcass and be mounted thereon, be fixedly connected to the bearing block (20) and clamp the inner container (10) between opposing surfaces (64), such that the container (10) is mounted on the carcass without being fixed to the bearing block (20), wherein at least one connecting element (60) is provided, which connects the interconnecting element (30) and/or the inner container (10) with one or more walls (40) of the carcass of the appliance, and the connecting element (60) includes two elements (64) pivotally mounted relative to each other by a hinge (62), between which elements a portion of the inner container (10) is accommodated in the condition of the elements (64) swivelled against each other.

21. A refrigerator and/or freezer having a carcass, at least one inner container (10) arranged within the carcass for receiving goods to be refrigerated and/or frozen, at least one bearing block (20) arranged for mounting thereon, one or more doors by which the carcass can be closed, at least one interconnecting element (30) arranged to extend in a region between two walls (40) of the carcass and be mounted thereon, be fixedly connected to the bearing block (20) and clamp the inner container (10) between opposing surfaces (64), such that the container (10) is mounted on the carcass without being fixed to the bearing block (20), wherein means are provided by which the bearing block (20) can be fixed in a preferred position, and said means are formed by either (i) one or more resilient tabs (72), which are arranged on the connecting element (60), or (ii) a screw (82), which is located in a threaded hole of the bearing block (20) and which is arranged such that it fixes the bearing block (20) relative to the interconnecting element (30), wherein at least one connecting element (60) is provided, which connects the interconnecting element (30) and/or the inner container (10) with one or more walls (40) of the carcass of the appliance, and wherein one or more walls (40) of the carcass of the appliance are connected with the connecting element (60) via a latch or clamp connection.

* * * * *